United States Patent [19]

Herveling et al.

[11] 4,019,326

[45] Apr. 26, 1977

[54] NONWOVEN HORIZONTAL DRAINAGE SYSTEM

[75] Inventors: Wilhelm Herveling, Wuppertal; Alfred Birker, Neviges-Donberg; Berthold H. Daimler, Remscheid-Lennep, all of Germany; Jan G. Vos, Dieren (Gld.), Netherlands; Hans Stapp, Momlingen, Germany

[73] Assignee: Akzona Incorporated, Asheville, N.C.

[22] Filed: Dec. 4, 1972

[21] Appl. No.: 311,656

[52] U.S. Cl. ..... 61/11; 210/491

[51] Int. Cl.[2] ..... E02B 11/00

[58] Field of Search ..... 61/11, 13, 10, 12; 161/156, 166, 159, 169; 47/9, 56; 239/201; 210/491

[56] References Cited

UNITED STATES PATENTS

| | | | |
|---|---|---|---|
| 3,264,828 | 8/1966 | Marpold | 61/11 |
| 3,384,241 | 5/1968 | Nostrand | 210/491 |
| 3,461,675 | 8/1969 | Izatt | 61/11 |
| 3,670,506 | 6/1972 | Gaudard | 404/17 |
| 3,691,004 | 9/1972 | Werner et al. | 161/166 |
| 3,744,256 | 7/1973 | Cobb et al. | 61/13 |
| 3,754,362 | 8/1973 | Daimler et al. | 52/309 |
| 3,759,393 | 9/1973 | Tate et al. | 210/491 |

FOREIGN PATENTS OR APPLICATIONS

| | | | |
|---|---|---|---|
| 856,068 | 5/1940 | France | 61/10 |
| 1,484,369 | 3/1969 | Germany | 61/11 |
| 45-38013 | 2/1970 | Japan | 61/38 |
| 6,916,418 | 10/1969 | Netherlands | 61/13 |

*Primary Examiner*—Paul R. Gilliam
*Assistant Examiner*—Alex Grosz
*Attorney, Agent, or Firm*—Francis W. Young; Jack H. Hall

[57] ABSTRACT

A horizontal soil drainage system consisting of a nonwoven three-dimensional mat of a plurality of looped, intersecting and substantially amorphous filaments of melt-spun synthetic polymers bonded together at their intersections, at least one of the outer surfaces of said mat having a lower cross-sectional porosity than the center zone of said mat.

4 Claims, 4 Drawing Figures

NONWOVEN HORIZONTAL DRAINAGE SYSTEM

Figure 1:
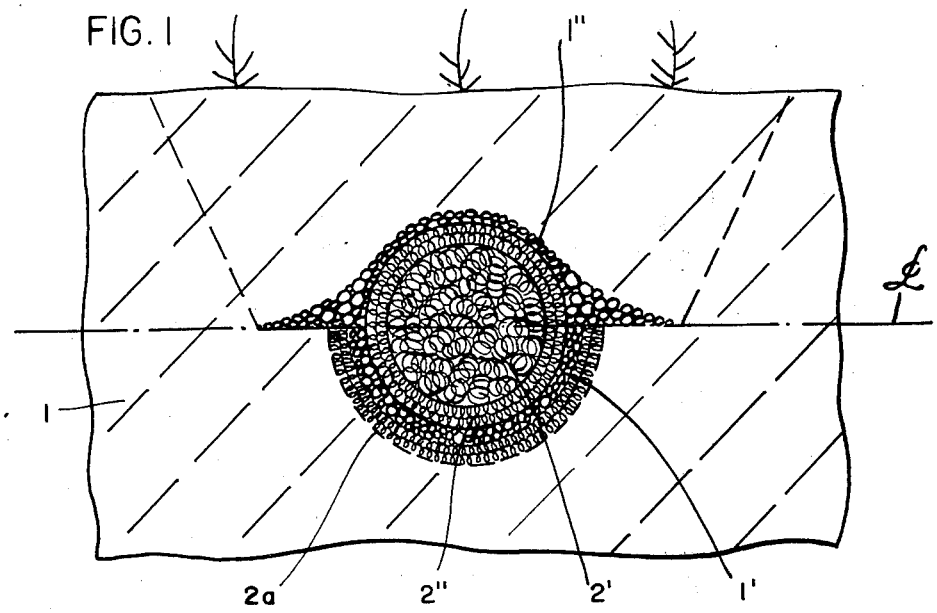

This invention is directed to a horizontal nonwoven drainage system intended in particular for soil drainage.

It has already been proposed to fill the bottom third of flower pots with a random-fiber nonwoven consisting of coarsedenier crimped fibers, cf. German Utility Model Pat. No. 7,023,734. This is said to provide a satisfactory drainage effect and, at the same time, uniformly ventilates the roots of the plants, cf. report in "Chemiefasern 21", March 1971, page 182, bottom of the right-hand column.

It is known also that the cultivation medium for water cultures can be prepared by introducing crimped fiber structures of crimped fibers of fine to average denier into a container which is then filled with earth, cf. German Utility Model Pat. No. 7,023,735. Once again, the main object here is to water and aerate the roots of the plants.

However, mats or nonwovens have been proposed not only for watering, but also for drainage purposes. German Utility Model Pat. No. 7,039,906 describes a vertical drainage system for foundation walls comprising a wide-pored filter layer between the surrounding soil and the layer of damp-proofing compound on the wall and a drainage pipe diverting the water trickling through this filter layer, the filter layer consisting of nonwoven mats of filament-forming synthetic polymers.

It has now been discovered that nonwoven mats of three-dimensional nonwoven structures consisting of filament-forming synthetic polymers can be used with considerable advantage for horizontal drainage systems which, for draining excessively moist soil, fields, meadows, or the like, penetrate through the soil in the form of drainage strands extending through the soil in accordance with predetermind patterns.

The main advantage of the horizontal soil drainage system according to the invention which is distinguished by the fact that it consists of nonwoven structures of filament-forming synthetic polymers, are as follows: first, the nonwoven structures can be offwound almost continuously from a mobile roll, which enables the drainage to be installed quickly and very rationally in terms of building technology. Secondly, a horizontal drainage system of this kind remains self-cleaning for several years because it enables a much higher porosity to be maintained than is the case with conventional clay or plastic-pipe drainage systems. Finally, a nonwoven structure of the kind in question is also much more resistant to local mechanical stressing before, during, and after laying so that the usual waste of drainage material that is inevitable with clay and plastic pipes, is almost completely avoided.

In order to prevent the nonwoven structure from losing individual fibers which would be flushed away with the water and would gradually block the drainage system, for example, in the collecting drain, a nonwoven structure consisting of endless filaments is preferably used in accordance with the invention.

A particularly stable horizontal drainage system with an excellent drainage effect is obtained when the nonwoven structures consist of a plurality of looped, intersecting substantially amorphous filaments of melt-spun polymers which are bonded together at their intersections.

The outer surfaces of the nonwoven structures facing the ground preferably have a lower porosity than the centers of the nonwoven structures in order to free the water entering the nonwoven structures from the soil from relatively large suspended particles on the outside. Accordingly, the layers of lower porosity have a filtering effect. The relatively small suspended particles which penetrate through these layers are flushed away by the water at the center. For this purpose, it is possible to make only the upper side less porous, or alternatively, the upper and lower sides are of relatively low porosity. However, the entire outer surface can, of course, also have a relatively low porosity.

The preferred fleece or web structures are formed in accordance with the processes disclosed in detail in U.S. Pat. No. 3,691,004 and 3,687,759, which are incorporated herein by reference as fully as if set forth in their entirety.

In one preferred embodiment of the horizontal drainage system according to the invention, the nonwoven structures comprise at their center a full-length cavity extending along the drainage strands. In cases where, for example, the nonwoven structure is in the form of a circular cylinder with an external diameter of 15 cm., this similarly cylindrical cavity can have an internal diameter of from about 5 to 10 cm. In this way, a resistance-free flow interior is obtained for carrying the water to be removed.

In a modification of this three-dimensional form, two or more full-length cavities can be provided.

In the preferred embodiment with the full-length cavity, the nonwoven structure is intended in particular to assume a tubular form, preferably a tubular form of circular or rectangular, preferably square cross-section.

In these embodiments, it is also of advantage for the inner surfaces of the nonwoven structure facing the full-length cavity to have a lower porosity than the remaining parts of the center zones. In this connection, the porosity of this inner surface does not necessarily have to be the same as that of the outer surfaces.

In cases where the horizontal drainage system according to the invention is continuously laid by unrolling from a mobile roll, each drainage strand is in one piece, i.e., consists of a full-length and, in extreme cases, quasi-endless nonwoven structure.

The nonwoven structures which can consist of fibers or of endless filaments can be made of almost any filament-forming substance. Polyamide fibers are preferred by virtue of the high resistance of polyamide to rotting, although it is, of course, also possible to use other synthetic polymers such as polyesters, polypropylene, or polyvinylchloride.

The filaments of fibers utilized can vary from fine to coarse in denier, preference being given to coarser deniers.

The porosity of the nonwoven structures can be fluctuated between 50% and about 70% in the external and internal zones, while the center zones have a preferred porosity of greater than 85%.

The horizontal drainage system of this invention can be combined with conventional drainage aids such as sand, fine gravel or coarse gravel.

The invention is illustrated by way of example in the accompanying drawings, wherein:

FIG. 1 is a section through a horizontal soil drainage system according to the invention in which the nonwoven structure is situated in the soil 1 and, in addition to the center zone 2′, comprises a peripheral zone 2″ of relatively low porosity; the nonwoven structures can be introduced into a nonwoven bed at least partly surrounding them, although this has not been shown.

Figure 2:
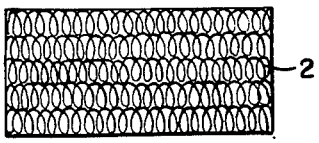

FIG. 2 is a section through a nonwoven structure 2 of rectangular cross-section, its porosity being substantially the same throughout; individual outer surfaces or all outer surfaces can, of course, have a lower porosity than the rest of the nonwoven structure (not shown).

Figure 3:
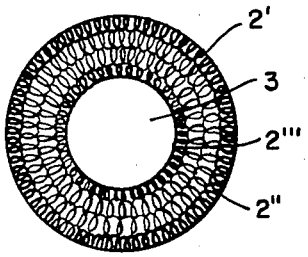

FIG. 3 is a section through a nonwoven structure 2 with a full-length cavity 3; in this case, not only the outer peripheral zone 2″, but also the inner peripheral zone 2″, is less porous than the center zone 2′.

Figure 4:
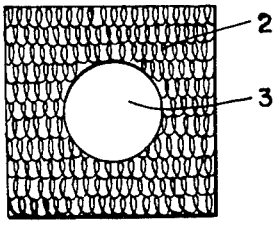

FIG. 4 is a section through a nonwoven structure 2 with a square cross-section and a full-length cavity 3.

The cavity can, of course, also be displaced further towards the lower edge of the nonwoven structure, or instead of only one cavity, two, three, or more cavities can be provided. This variation is as much within the scope of the invention as the modification of the cross-section to a hexagon, for example. Hexagonal tubes can be rolled by particularly economically in terms of space.

A preferred method for installing the drainage system of the invention can be described as follows in connection with FIG. 1. A sheet or web of looped filaments having a low porosity, i.e., a high density, is laid as a U-shaped or semi-circular channel 2A in the partly excavated ground 1 (indicated by broken lines). A natural drainage material such as a relatively coarse gravel 1′ large enough to be retained by the parallel rows of looped filaments of the web 2*a* is then arranged in a similar semi-circular layer on this web 2*a*. The cylindrical fleece or looped filamentary body or pipe having an inner core section 2′ of greater porosity than the outer annular section 2′ is then inserted onto the gravel lined semi-circular channel 2*a*. A top layer of gravel 1″ is then placed over and around the upper exposed half of the filamentary pipe and the excavation is then completely filled.

The filamentary web or sheet layers 2*a* and 2″, as well as the core section 2′ preferably consist essentially of continuous filaments 2 (see FIG. 2) of a melt-spun, substantially amorphous fiber-forming synthetic polymer which is resistant to water and aging when installed in the ground, these continuous filaments being looped in adjacent rows for random intersection of correspondingly adjacent overlapping loops with adherence to their points of intersection.

The core section 2′ preferably has approximately spiral or helical loops extending around parallel axes which run lengthwise of the filamentary pipe or porous fleece conduit, thereby providing a certain degree of compressive strength in radial direction. The webs or sheets 2*a* and 2″, on the other hand, are preferably composed of adjacent rows of similar or helically looped filaments in a concentric circular pattern, i.e., transversely of a planar sheet which can be curved into a semi-circular piece 2*a* or a circular element 2″ concentrically around the cylindrical core member 2′. The gravel 1′ and 1″ can partly penetrate these webs 2*a* and 2″ but should be retained by the closely arranged looped and adherently fixed filaments.

The drainage system of the invention is thus particularly advantageous in providing a filamentary web conduit which is very light in weight and can be quickly and simply installed in continuous or at least semi-continuous length.

The present invention can be varied within the scope of the present total specification as it would be construed by one skilled in the art in assessing equivalent variations that would function to achieve essentially the same results as herein exemplified.

What is claimed is:

1. A horizontal soil drainage system consisting of a nonwoven three-dimensional mat in tubular form comprising a plurality of looped, intersecting and substantially amorphous continuous filaments of melt-spun synthetic polymers self-bonded together at their intersections, said mat forming at least one central cavity throughout its length, and having an inner peripheral zone adjacent said central cavity and an outer peripheral zone and a center zone between said inner and outer peripheral zones, and wherein at least one of said peripheral zone of said mat has a lower cross-sectional porosity than the center zone of said mat.

2. A horizontal soil drainage system according to claim 1 wherein said filaments are melt-spun polyamide.

3. A horizontal soil drainage system according to claim 1 wherein said outer peripheral zone of said nonwoven mat has a cross-sectional porosity from 50% to 70% and said center zone has a porosity of 85%.

4. A horizontal soil drainage system according to claim 1 wherein said nonwoven mat is cylinder in cross-section.

* * * * *